United States Patent [19]

Libit

[11] 4,446,981

[45] May 8, 1984

[54] TAMPERING INDICATING BOTTLE CAP AND METHOD OF CLOSING A BOTTLE

[76] Inventor: Sidney M. Libit, 141 Lakeside Ter., Glencoe, Ill. 60022

[21] Appl. No.: 433,104

[22] Filed: Oct. 6, 1982

[51] Int. Cl.[3] ..... B65D 41/28

[52] U.S. Cl. ..... 215/354; 53/488

[58] Field of Search ..... 215/341, 344, 354, 320; 53/488, 489, 490

[56] References Cited

U.S. PATENT DOCUMENTS 1,162,519 11/1915 Schuster ..... 215/354 X 3,057,501 10/1962 Kroenert ..... 215/354 X

FOREIGN PATENT DOCUMENTS 1159427 2/1958 France ..... 215/354

*Primary Examiner*—Donald F. Norton

*Attorney, Agent, or Firm*—Hill, Van Santen, Steadman & Simpson

[57] ABSTRACT

Bottle cap having an outer peripheral skirt for receipt around the neck of a bottle has an axial end for closing the bottle mouth. The axial end has a central raised portion the bottom periphery of which flanges outward to form a peripheral top collar portion which overlies the thickness of the bottle neck end face with the peripheral wall of the central portion having an o.d. not greater than the inner diameter of the bottle neck portion. The central portion of the top is collapsible vertically downwardly with the peripheral wall convoluting interior of the bottle neck into pressed circumferential engagement with the i.d. to provide an effective 360° seal. Upon removal of the so-collapsed top from the bottle, and attempted closure, the convoluted portion will interfere with the neck wall of the bottle forcing the central portion to project upwardly providing a tell-tale sign that the bottle has been opened.

14 Claims, 6 Drawing Figures

TAMPERING INDICATING BOTTLE CAP AND METHOD OF CLOSING A BOTTLE

BACKGROUND OF THE INVENTION

1. Field of the Invention

This invention relates to container closures and more particularly to a plastic bottle cap.

2. Description of the Prior Art

Molded plastic bottle caps for containers having projecting necks are well known. Further, tamper proof or tamper indicating bottle closures have also been well known. Recently, a new style of plastic cap having a axial end wall with circumferentially inner and circumferentially outer portions with the circumferentially inner portion connected to the circumferentially outer portion through a downwardly projecting convoluted band has been proposed. The inner portion has two stable positions, one projecting considerably above the circumferentially outer portion and the second stable position having the top of the central portion lying substantially on a plane with the circumferentially outer portion. The cap is installed on the bottle with the inner portion initially in the raised position and the convolution band extending downwardly into the neck of the bottle from the circumferentially outer portion then reversing itself and projecting outwardly to the raised central portion. Thereafter the central portion is depressed to the position where its axial top is substantially planar with a circumferentially outer portion and the convoluted portion rolls downwardly into the bottle to accommodate the change in height of the inner portion. Such caps are shown, for example, in U.S. Pat. No. 4,341,320 issued July 27, 1982, to Sideny M. Libit, the teachings of which are herein specifically incorporated by reference.

Such bottle caps have the practical benefit of being able to indicate when the bottle has been opened subsequent to packaging. Since an attempt to replace the cap on the bottle will cause the convoluted band to engage the axial end of the bottle neck, further attempts to screw the cap onto the bottle neck will cause the central portion to resume its raised position. While such caps are therefore an important advance over prior art non-tamper indicating caps as well as many types of prior art tamper indicating caps, they have a disadvantage in that due to the initial downward projection of the convoluted portion they may be somewhat more difficult to attach to the neck by automated capping machines due to the absolute necessity of aligning the bottle neck between the skirt and the convolution band so that the skirt is aligned with the o.d. of the bottle neck and the convolution band aligned with the i.d. of the bottle neck. If the gap between the skirt and the o.d. of the convolution band is greater than the thickness of the bottle neck material, then a gap could occur between the bottle neck i.d. and the convolution band o.d. which gap could adversely effect sealing. Since bottle necks, particularly molded or blown plastic bottles do not normally have precise neck inner diameter surfaces, due to the inherent nature of the blow molding process, such prior art caps where the convolution band initially projects into the interior of the bottle neck may have disadvantages.

It would therefore be an advance in the art to provide an improved plastic bottle closure having the advantages of tamper indication disclosed in the aforementioned prior art while avoiding the defficiencies of that prior art caused by the use of the convolution band.

SUMMARY OF THE INVENTION

This invention seeks to overcome the disadvantages of the prior art discussed above and does so by the elimination of the convolution band projecting initially into the bottle neck.

The bottle cap of this invention incorporates a peripheral skirt portion adapted to be received around the o.d. of the bottle neck and having a radially inwardly projecting top at one axial end. The top has a radially outer portion projecting inwardly from the skirt terminating in a axially projecting circumferential wall which projects axially beyond the top radially outer portion in a direction opposite the projection of the skirt. The axially projecting circumferential wall terminates in the top center portion. The radially outer portion is dimensioned such that the axially projecting circumferential wall lies substantially radially inwardly of the o.d. of the bottle neck.

The circumferential wall of the top is formed throughout a major portion of its length from the radially outer portion towards the top center portion with a relatively thin wall cross section. In this manner the circumferential wall is convolutible to allow axial collapse of the top center portion from a position projecting above the top outer portion to a position coplanar or only slightly raised above the top outer portion. This is accomplished by collapsing the circumferential wall in a convoluted shaped downwardly into the interior of the bottle neck. Due to the inherent resiliency of plastic materials, including PVC and polypropylene type materials and others presently utilized and known to be suitable for closure materials, the circumferential wall will collapse downwardly in a reverse U-shaped bend rather than merely crumple downwardly. As this occurs, the outer leg of the collapsed convolution will exert a radially outer force to form it into snug engagement with the inner diameter of the bottle neck.

The closure cap has a stable position with the top center portion depressed approximately coplanar with the top radially outer portion after convolution of the circumferential wall. In this position, the bottle will be effectively sealed both because the under surface of the closure cap lies pressed against the circumferential axial end of the bottle neck and because the outer diameter leg of the convolution will be pressed against the inner diameter of the bottle neck. Surprisingly, testing has shown that the effect of the convolution pressing against the inner diameter of the bottle neck provides a closure cap where the removal force, or unthreading force required to remove the closure cap from the bottle neck is greater than the initial force required to attach the uncollapsed closure cap to the bottle neck. This desirable feature of having a greater removal force than closure force is caused entirely by the increased frictional resistance to rotation or axial movement created by the contact between the bottle neck i.d. and the convoluted circumferential wall portion o.d. which can be enhanced by proper dimensioning of the top center portion as will be more fully explained hereinafter.

When the cap is removed from the bottle neck, the convolution of the circumferential wall will retain its shape but will radially expand once freed from the restraint imposed upon radial expansion by the neck inner diameter. Attempted reclosure of the bottle will cause the convolution to abut the axial circumferential end face of the bottle neck resisting proper attachment of the closure cap to the bottle neck. Application of force sufficient to cause the closure cap to be attached to the bottle neck will cause the top central portion to project above the radially outer portion thus providing a tell tale that the container has been opened and thereafter reclosed.

Surprisingly, I have found that by properly dimensioning the cap that the type of projection of the central portion which can be caused to occur upon reclosure of the bottle is a cocking of the central portion of the closure cap in the remaining portions of the closure cap such that the degree of projection on one side is greater than the degree of projection on the other side. In this manner a tell tale for opening and closure of the container is provided which is different than the condition of initial failure to close properly. Additionally, it has been determined that the container can be designed and constructed such that the force required to return the top center portion to the fully closed position from the tilted or cocked position, or from the initial straight projected position, is greater than can be applied by average thumb or hand pressure thereby increasing the utility of this device as a tamper indicating closure.

I have further found it desirable to initially cause closure to be accomplished by a attachment member which has a bore closely receiving the axially projecting circumferential wall and which has a movable plunger in the bore which is engageable with the top center portion. This attachment device is utilized after threading of the closure cap onto the bottle neck. The use of a bore which tightly receives the circumferential wall assures that the wall will convolute inwardly into the interior of the bottle neck rather than outwardly overlying the radially outer portion. The device may, if desired, be integrated with standard threading spindles or other standard capping devices commonly used in automatic filling and capping machines.

It is therefore a preliminary object of this invention to provide an improved plastic closure cap having tamper detection means.

It is another, and general object of this invention to provide an improved plastic closure cap having a raised central top portion collapsible into the interior of the neck of a container through a U-shaped bend section which engages the inner diameter surfaces of the container neck.

It is another, and more specific object of this invention to provide a tamper detecting closure cap having a skirt portion for receipt around the outer diameter of a container neck, a radially outer top portion receivable over the axial end of the bottle neck and a central portion projecting therefrom axially of the radially outer portion opposite the skirt projection, the central portion having a thin cross section circumferential wall collapsible into the interior of the container neck through a reverse U bend, the projecting circumferential wall initially extending only axially of the outer portion and deformable under force to a convoluted shape having inner and outer diameter U-shaped cross section legs received interiorly of the neck with the top of the center portion lying adjacent to or substantially planar with the radially outer portion.

It is yet another, and more specific object of this invention to provide a tamper detecting closure cap having a skirt portion for receipt around the outer diameter of a container neck, a radially outer top portion receivable over the axial end of the bottle neck and a central portion projecting therefrom axially of the radially outer portion opposite the skirt projection, the central portion having a thin cross section circumferential wall collapsible into the interior of the container neck through a reverse U bend, the projecting circumferential wall initially extending only axially of the outer portion and deformable under force to a convoluted shape having inner and outer diameter U-shaped cross section legs received interiorly of the neck with the top of the center portion lying adjacent to or substantially planar with the radially outer portion and wherein the outer diameter leg of the convoluted bend exerts radial expansion force against the inner diameter of the bottle neck such that upon removal of the closure from the bottle neck the outer diameter leg will radially expand to a dimension greater than the inner diameter of the mouth opening of the bottle neck such that upon attempted reclosure of the container by the cap, a portion of the center portion will be forced upwardly away from the radially outer portion by contact between the convoluted bend section and the axial end of the neck of the container.

Other objects, features and advantages of the invention will be readily apparent from the following description of preferred embodiments thereof, taken in connection with the accompanying drawings, although variations and modifications may be effected without departing from the spirit and scope of the novel concepts of the disclosure, and in which:

DESCRIPTION OF THE PREFERRED EMBODIMENTS

Figure 3:
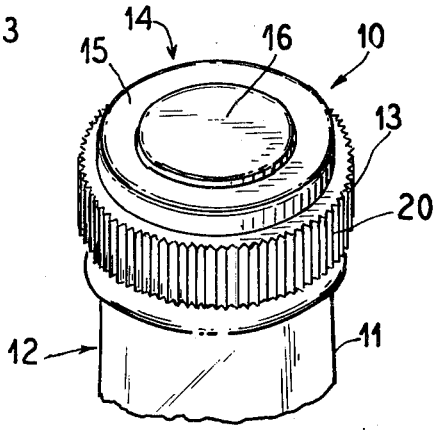
FIG. 3 is a fragmentary perspective view of the bottle neck with the closure fixed thereto after the operation of FIG. 2.

As best illustrated in FIG. 3 the closure cap 10 of this invention is designed to be affixed to the neck 11 of a container or bottle 12. The closure cap includes a peripheral skirt portion 13 and a top 14. The top consists of a radially outer portion 15 and a central portion 16. In the fully attached position, illustrated in FIG. 3 the central portion 16 is approximately coplanar with the outer portion 15.

Figure 1:
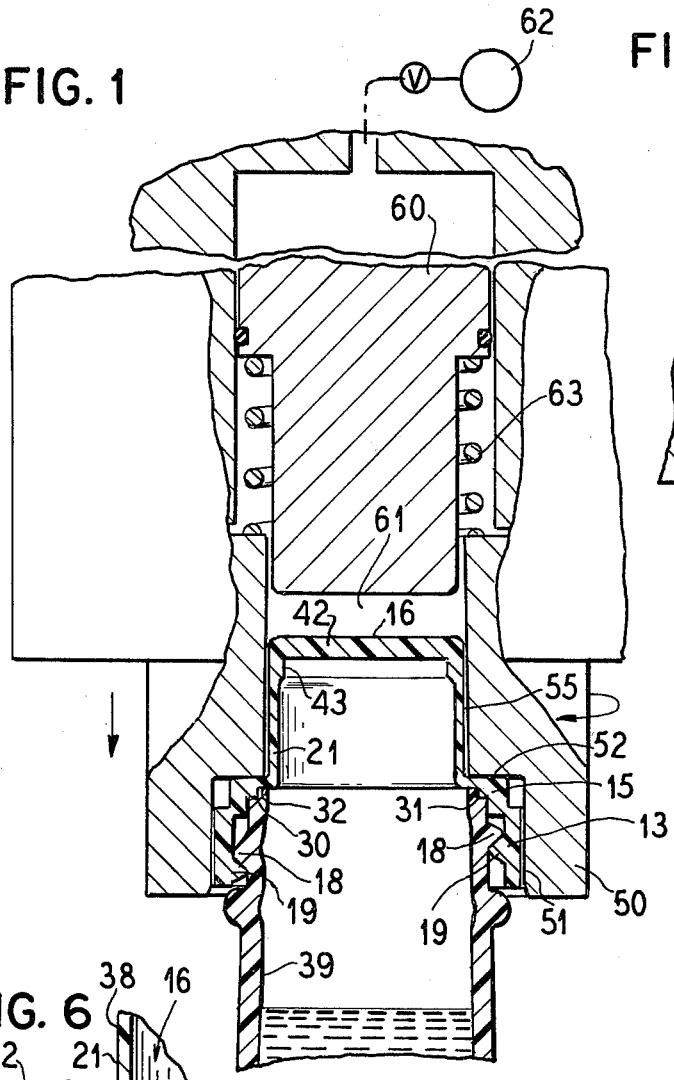
FIG. 1 is a fragmentary sectional view of a container having the closure of this invention fixed to the neck opening thereof, the view illustrating the closure at the time of attachment and showing one type of device for attaching the closure.

As best illustrated in FIG. 1 the bottle neck may be of the type having outer diameter threads 18 with the skirt portion having mating inner diameter threads 19. Alternatively the bottle neck may, if desired, be of the type having a single radially extending bead with the closure being a snap on closure having a single interfitting radially inwardly extending bead.

Figure 6:
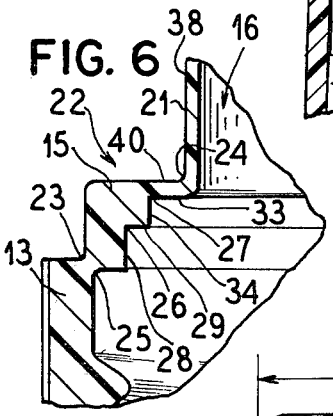
FIG. 6 is an enlarged fragmentary sectional view of a portion of the closure cap.

The skirt portion 13 may be knurled at the outer diameter as indicated at 20. The closure 10 is preferably molded of plastic, and where used in connection with food containers such as soft drink containers will be molded of a FDA approved plastics material. The closure is initially formed, substantially as shown in FIG. 1, with the central portion 16 projecting substantially above the radially outer portion 15 and being formed substantially cup-like or hat-like. As best illustrated in FIG. 6 the axially projecting circumferential wall 21 of the central portion 16 interconnects with the skirt 13 through a ledge area 22. The ledge area 22, on the inner diameter may be provided with a first outer diameter step 23 at a juncture between the skirt 13 and the radially outer portion 15 and a second step 24 at the junction between the radially outer portion 15 and the circumferential wall 21. On the inner diameter three such steps 25, 26 and 27 may be provided, the step 25 lying opposite the step 23 at the juncture between the skirt and the radially outer portion 15. The step 25 and its associated first axial wall 28, when attached to the neck of the bottle lie outwardly of the outer diameter of the bottle neck and may substantially engage the outer diameter of the bottle neck adjacent the mouth thereof. The radial wall 29 of step 26 will overlie at least a portion of the axial end of the bottle neck at the mouth opening providing a first circumferential seal land upon complete threading down of the closure on the bottle neck. As shown in FIG. 1 the bottle neck may be provided with a step 30 at the mouth opening with the radially outwardly extending wall of the step 31 contacting the wall 29. A radially inner portion of this step, extending axially beyond the radially outer portion terminates in a wall 32 which contacts the radial wall 33 of step 27 with the axial wall 34 engaging the axial wall of the step 30 of the container mouth.

Where the container is not provided with a step mouth opening, but is rather provided with a flat mouth opening, the mouth will preferably contact the radial wall 29 of step 26 and in some instances step 27 and its associated axial wall 34 and radial wall 33 may be eliminated whereby radial wall 33 will be positioned at radial wall 29 which, however, for reasons to be discussed hereinafter would lie at approximately the position of radial wall 33 of FIG. 6.

Importantly the outer diameter 38 of wall 21 lies radially inwardly of the inner diameter 39 of the container neck and the thickness of the wall section 40 between radial wall 33 and the radially inner most portion of the radial outer portion 15 of the top adjacent step 24 is relatively thin. This constructional feature provides a relatively thin wall section immediately radially inwardly of the inner diameter line of the bottle neck. This portion of the wall 40 which extends radially inwardly of the inner diameter of the bottle neck may be extremely small such that the outer diameter 38 of circumferential wall 21 may lie almost on the line of the inner diameter 39 of the bottle neck, however it is believed important that, preferably, the outer diameter 38 of the circumferential wall 21 should not extend radially outwardly beyond the inner diameter 39 of the container neck.

Further, as will be appreciated from FIG. 1 and FIG. 6 the circumferential wall 21 is relatively thin in cross section for a major portion of its length from step 24 to the top 42 thereof although it preferably will increase in thickness adjacent the top 42 as shown at 43.

The closure is attached to the bottle neck by normal methods. For example, where the closure is to be screwed onto the bottle neck, a chuck 50 having a bore 51 engaging the knurl 20 of the skirt 13 may be utilized, the chuck being a spinning chuck and having a bore bottom 52 engaging the radially outer portion 15 whereby both axial and rotational force can be imparted to the closure to urge it towards the bottle neck and to thread it thereon. Such automatic spindle cappers are well known to the art.

However, because of the projecting central portion, a secondary coaxial bore 55 can be provided in the chuck 50, that bore having an inner diameter dimension approximately equal to the outer diameter of the axially projecting circumferential wall 21. In this manner the inner diameter bore 55 will be aligned approximately along the line of the inner diameter 39 of the container neck when the skirt 13 has been threaded onto the container neck and the wall 21 of the closure will be restricted against radial outward movement.

A plunger member 60 can be provided having a bottom 61 received in the bore section 55 opposite the end 42. The plunger may be axially movable in the bore 55 by any desired means, such as, for example by fluid pressure from pump 62 which may be partially countered by return springs 63. After the cap has been affixed to the bottle neck, the plunger 60 can be activated to force the top 42 downwardly towards the bottle neck. This has the effect shown in FIG. 2 where the wall 21 has collapsed downwardly into the interior of the bottle neck.

Figure 2:
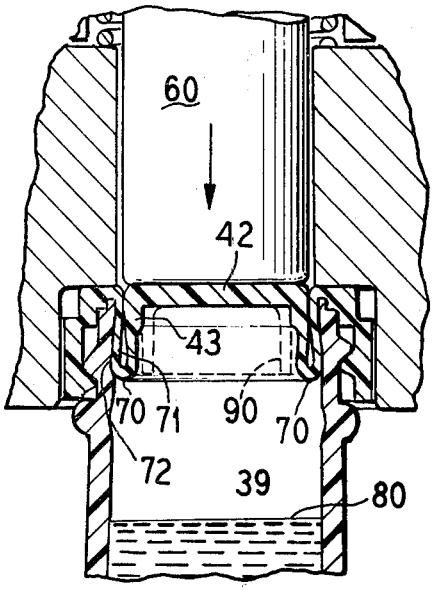
FIG. 2 is a fragmentary view similar to FIG. 1 showing the depression of the closure central portion.

As the ram 60 descends the wall 21 will bend inwardly. Due to the reduced thickness portion 40 adjacent the step 24 the bend will occur approximately about the step 24 or at the o.d. of the step such that substantially the entirety of the wall 21 will flow downwardly in a rolling bend until the position of FIG. 2 is assumed. At that point a portion of the U bend 70, or circumferential portions thereof may be slightly crimped to accommodate the thickness of the material. Importantly the outer diameter leg 71 will be expanded outwardly by the resilient force of the material so as to be in snug engagement with the inner diameter of the bottle neck. Even in those instances where slight diameter changes occur, as indicated at 72 of FIG. 2, for example in the vicinity of an external projecting thread, the outer diameter leg 71 will attempt to conform with the diameter change maintaining a seal. Additionally, because of the thickened portion 43 at the top 42, which provides more resistance to bending, the upper portions of the outer diameter leg 71 will be compressed into engagement with the inner diameter 39 of the container neck. Further, as the cap assumes the position of FIG. 2, the compression of the gas in the bottle above the liquid level 80 will aid in forcing the legs of the U outwardly in the manner of a lip seal. Surprisingly, when in this position, the cap will achieve a stable position where there is not a tendency for the center portion of the cap to return to the full projection position illustrated in FIG. 1.

Figure 4:
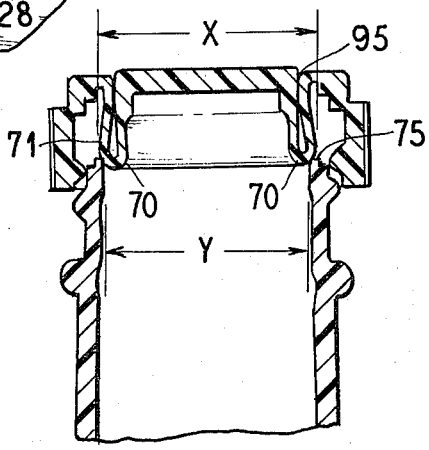
FIG. 4 is a fragmentary sectional view of the bottle neck and closure after removal of the closure and at the time of attempted reattachment of the closure.
Figure 5:
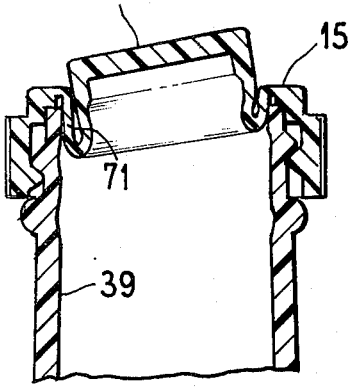
FIG. 5 is a view similar to FIG. 4 showing reclosure attachment.

However, upon removal of the cap, is shown in FIG. 4 the legs of the convolution or bend will radially expand to a dimension X which is greater than the dimension Y of the throat opening of the bottle neck. Any attempted reclosure will cause the bight 70 of the bend, at least adjacent the outer leg 71 to contact the axial end 75 of the bottle neck due to the increase of the diameter X over the diameter Y. Further attempt at reclosure will cause at least one portion of the convoluted portion to be pushed upwardly as shown in FIG. 5 such that the central portion 16 of the closure will again project above the radially outer portion 15. The cocking illustrated in FIG. 5 occurs because during the attempted reclosure the central portion 16 will pivot or rock about the convolution or bend until there exists sufficient space between the outer leg 71 and the inner diameter 39 of the bottle neck around at least a portion of the circumference of the convolution for the bottle neck to move into that space. On the opposite side, however, the convolution will have been pushed upwardly to provide for the increased space on the first side. In fact, the convolution may extend upwardly to the point where the entirety of the bend on the opposite side lies with its bottom equal planar with the top of the bottle neck. The cocking is of course affected by the ability of the disk like top portion to fit interior of the land 15.

It can therefore be seen that attempted reclosure will provide a tell tale indication that the container has been opened and reclosed. Moreover, the force necessary to return the cap to the uncocked full depressed position shown in FIG. 2 is quite large due to the basic interference fit situation which has now been assumed by reason of the radial expansion of the bend o.d. leg. This particularly true because of the cocking where the thickened portion 43 of at least a portion of the periphery of the central portion will already be opposed by the radial outer portion 15. Surprisingly it has been found that the force requirement is sufficiently large that normal thumb pressure will not be sufficient to return the cap to its full depressed position.

FIG. 5 differs from FIG. 4 in that it shows a flat ended bottle. In such cases the step 27 may remain to provide the required thinness of land 40. It will be appreciated that this cap provides specific advantages over the prior art. First it is easy to manufacture and can be attached to a container with minor modifications to existing packaging machinery. Although I have illustrated a device which can thread the cap onto the bottle neck and depress the central portion at one station of the filling and capping machinery, it is to be understood that the top portion could be depressed at a succeeding station from the capping operation. Moreover the step 23 can be eliminated if different bottle shapes or different capping devices are to be used. Once the central portion is depressed a very liquid tight seal is provided both due to the standard seal between the axial end face of the bottle neck and the overlying cap portions and due to the projection extending downward into the neck acting as a circumferential lip seal. Additionally, increase in pressure in the container will merely cause the cap to seal tighter by increasing the lip seal effect. Thus the closure provides a corkage effect for the container. Further, as previously mentioned, due to the engagement between the outer diameter leg of the bend and the inner diameter surface of the bottle neck, the removal force for opening the container is greater than the initial force required to thread the closure onto the container. This is a desirable feature in that it tends to ensure that the container will not accidentally be opened by normal transport vibration in the like.

Finally, however, the closure is relatively easily removable and is reclosable. Moreover, the closure is substantially leak proof even in the reclosed condition shown in FIG. 5. This allows the purchaser of the container to use a small portion of the contents thereof and to reclose the container.

It is to be understood of course that certain modifications of this invention will be readily apparent to those skilled in the art. For example, as illustrated by the broken lines of FIG. 2, an inner sleeve 90 may be provided depending from the top 42 in close spaced relationship to the bend 70 which will be formed upon depressing the central portion. This sleeve 90 will aid in preventing the bend from extending radially inwardly and assist in assuring that a proper seal is made with the inner diameter 39 of the bottle neck. In addition, although I have described the top 42 as lying substantially coplanar with the outer portion 15, if desired, the stable depressed position could be provided with the top 42 slightly depressed or slightly projecting with respect to the top of the radially outer portion 15. Additionally, it will be appreciated that substantially no gap remains between the outer diameter of the center portion and the inner diameter of the radially outer portion 15 when the cap is depressed. For example, as is shown in FIG. 4, due to the dimensioning of the center portion, upon depressing the top portion 42 down to the level of the outer portion 15, the gap formed at the convolution will be fully closed as illustrated at 95. Because of this there will be no circumferential gap which could become filled with debris.

Although the teachings of my invention have herein been discussed with reference to specific theories and illustrations, it is to be understood that these are by way of illustration only in that others may wish to utilize my invention in different designs or applications.

I claim as my invention:

1. A plastic closure cap for containers comprising a cup-shaped body member having an outer diameter axially extending skirt portion open at a first axial end thereof and a top portion closing a second axial end thereof opposite the first axial end, said top portion including a radially outer portion and an radially inner portion, the radially inner portion having an outer diameter less than the radially outer portion and projecting axially beyond the radially outer portion in a direction opposite the projection of the skirt and terminating in an end bottom wall, the axial projection of the radially inner portion from the radially outer portion to the end wall including a circumferential wall defining a hollow interior, the circumferential wall being yieldable whereby the top portion can be depressed from a first stable position spaced from the radially outer portion to a second stable position closer to the radially outer portion with the circumferential wall undergoing a U-shaped cross section convolution bend with the bight of the bend extending downwardly into the area bounded by the skirt during movement of the top closer to the radially outer portion, the bend being initially formed during such movement.

2. A plastic closure cap comprising a cup-shaped body having a circumferential skirt portion open at an axial end thereof and a top closing another axial end of the skirt portion, the top including a radially outer portion having a top surface and a center portion having a top surface, the top surface of the center portion extending axially beyond the top surface of the radially outer portion in a direction opposite the projection of the skirt from the radially outer portion, a peripheral wall interconnecting the radially outer portion and the center portion, the peripheral wall extending directly axially towards the center portion top from the radially outer portion top, the peripheral wall being collapsible under axial force applied to the center portion top to accommodate movement of the center portion top towards the radially outer portion top.

3. A molded plastic bottle cap and bottle neck combination comprising a cap having an outer peripheral axially extending skirt, an axial end wall at one end of the skirt, the axial end wall having a radially outer portion and a radially inner portion, the radially outer portion being connected to the radially inner portion through an axially extending circumferential wall, a bottle neck adapted to receive the bottle cap, the bottle neck having an inner diameter, the circumferential wall having an outer diameter, the outer diameter of the circumferential wall being not greater than the inner diameter of the bottle neck, the circumferential wall having a first stable position extending substantially axially directly from the radially outer portion and a second stable position collapsed inwardly of the bottle neck in a U-shaped cross section bend having an outer diameter leg interior of the bottle neck opposite the inner diameter of the bottle neck.

4. The combination of claim 3 wherein the outer diameter leg in the collapsed position is in circumferential engagement with the inner diameter of the bottle neck when the closure cap is affixed to the bottle neck.

5. The combination of claim 4 wherein the circumferential wall if formed of a resilient material and the outer diameter leg expands to a diameter greater than the inner diameter of the bottle neck upon removal of the container from the bottle neck.

6. The method of sealing a container having a bottle neck with an inner and outer diameter and an annular axial end face comprising the steps of providing a closure cap having a circumferential skirt portion closed at an axially end thereof by a top portion, the top portion having a first radially inwardly extending portion extending inwardly of the skirt and a second radially inwardly extending portion interconnected to the first radially inwardly extending portion by an axially extending circumferential wall projecting axially of the first radially inwardly extending portion in a directional opposite the skirt, affixing the skirt to the outer diameter of the bottle neck with a surface of the first radially inwardly projecting portion abutting the annular axial end and with the circumferential wall lying beyond the annular axial end, applying force to an exterior of the second radially inwardly extending portion in a direction towards the bottle neck, collapsing the circumferential wall into a U-shaped cross section convolution bend having at least portions thereof lying radially inwardly of the skirt and interior of the bottle neck, and engaging the inner diameter of the bottle neck circumferentially thereof with the radially outermost leg of the U-shaped cross section bend.

7. The method of claim 6 including the additional steps of continuing application of force to the second radially inwardly extending portion until a top surface of the radially inwardly extending portion approaches the radially outer portion, removing the force, retaining the cap in a stable position with the U-shaped bend lying interiorly of the bottle neck and the second radially inwardly extending portion positioned axially adjacent the first radially inwardly extending portion.

8. The method of claim 7 including the additional steps of opening the container by removing the cap therefrom, radially expanding the U-shaped bend by resilient force of the material of the cap until the outer diameter of the U-shaped bend is greater than the inner diameter of the container, reclosing the container with the cap, engaging, during reclosure the annular axial end wall with the U-shaped bend, and forcing at least portions of the second radially inwardly extending portion, as a result of the engagement away from the first radially inwardly extending portion in a direction opposite the projection of the skirt from the first radially inwardly extending portion and thereby providing a tell tale that the container has been opened and reclosed.

9. A molded plastic bottle cap and bottle neck combination comprising a bottle neck, a cap adapted to be received on the bottle neck having an annular axially extending outer peripheral skirt, an axial end wall at one axial end of the skirt, the axial end wall having a central portion and a radially outer portion with an axial circumferential wall extending between the central portion and the radially outer portion, the central portion having an outer diameter substantially equal to the outer diameter of the circumferential wall, the bottle neck having an inner diameter, the circumferential wall having an outer diameter not greater than the inner diameter of the bottle neck and the circumferential wall being axially collapsible upon the application of force to the central portion in the direction of the bottle neck when the cap is received on the bottle neck, the circumferential wall after collapse projecting into the interior of the bottle neck in a U-shaped bend, the U-shaped bend having an outer diameter leg sealingly engaging the inner diameter of the bottle neck, the U-shaped bend expanding to a diameter greater than the inner diameter of the bottle neck upon removal of the cap from the bottle neck.

10. A plastic molded bottle cap and bottle neck combination comprising a bottle neck, a cap adapted to be received on the bottle neck having an annular axially extending outer peripheral skirt, an axial end wall at one axial end of the skirt, the axial end wall having a radially outermost portion and a radially central portion interconnected by a substantially straight axially extending circumferential wall, the circumferential wall being movable from a first position extending axially above the radially outer portion to a second position forming an annular U-shaped bend below the radially outer portion and interior of the bottle neck, the U-shaped cross section portion having radially inner and radially outer legs, the radially outer leg of the U-shaped bend when in the second position sealingly engaging the inner diameter of the bottle neck when attached to the bottle neck and having an outer diameter greater than the inner diameter of the bottle neck upon removal of the cap from the bottle neck whereby an attempt to re-cap the bottle with the cap in the second position will cause interference between the axial end opening of the bottle neck and the radially outer leg of the U-shaped bend and cause movement of the central portion from the second position towards the first position, said cap having a stable position at the second position when fully seated on the bottle neck after forced movement from the first position to the second position and having a stable position at the first position prior to forced movement to the second position.

11. The combination of claim 10 wherein the central portion has an outer diameter substantially equal to the outer diameter of the circumferential wall.

12. The device of claim 11 wherein the circumferential wall has a relatively thin cross section and the central portion has a relatively thicker cross section.

13. The combination according to claim 12 wherein the central portion includes an axially extending portion joined to the circumferential wall.

14. The combination according to claim 13 wherein the circumferential wall has an outer diameter less than the inner diameter of the bottle neck and wherein the radially outermost portion includes a relatively thin cross section annular portion connected to the circumferential wall.

* * * * *